US005094097A

United States Patent [19]

Tooth, deceased et al.

[11] Patent Number: 5,094,097

[45] Date of Patent: Mar. 10, 1992

[54] HAND CRIMPING TOOL

[75] Inventors: William H. Tooth, deceased, late of Chertsey, by Florence L. Tooth, executor; Alan Roper, Walton on Thames, both of England

[73] Assignee: Miles Raystone Ltd., Nottingham, England

[21] Appl. No.: 482,900

[22] Filed: Feb. 22, 1990

[30] Foreign Application Priority Data

Feb. 25, 1989 [GB] United Kingdom ..... 8904376

[51] Int. Cl.[5] ..... H01R 43/042

[52] U.S. Cl. ..... 72/410; 29/751; 81/128; 81/313

[58] Field of Search ..... 72/410, 409; 81/128, 81/313, 355, 361; 29/751

[56] References Cited

U.S. PATENT DOCUMENTS

| | | | |
|---|---|---|---|
| 298,284 | 5/1884 | Brooks | 81/313 |
| 2,616,316 | 11/1952 | Dupre | 72/410 |
| 2,898,790 | 8/1959 | Lazar et al. . | |
| 3,199,335 | 8/1965 | Holmes | 81/313 |
| 3,359,779 | 12/1967 | Filia . | |
| 3,903,725 | 9/1975 | Rommel | 81/361 |
| 4,144,737 | 3/1979 | Izraeli | 72/409 |
| 4,221,048 | 9/1980 | Parramore | 72/410 |
| 4,542,668 | 9/1985 | Wiener et al. | 81/355 |

FOREIGN PATENT DOCUMENTS

| | | | |
|---|---|---|---|
| 0058375 | 8/1982 | European Pat. Off. . | |
| 0304173 | 2/1989 | European Pat. Off. . | |
| 1188156 | 9/1959 | France | 81/361 |
| 1341705 | 9/1963 | France | 72/409 |
| 2398580 | 2/1979 | France | 72/410 |
| 264025 | 1/1927 | United Kingdom . | |
| 979502 | 1/1965 | United Kingdom . | |
| 1100596 | 4/1965 | United Kingdom . | |
| 1341956 | 12/1973 | United Kingdom . | |
| 1593401 | 7/1981 | United Kingdom . | |

*Primary Examiner*—Daniel C. Crane
*Attorney, Agent, or Firm*—Oliff & Berridge

[57] ABSTRACT

A hand crimping tool includes a fixed mandrel (6), a moveable mandrel (8), and an operating mechanism (16) for the moveable mandrel (8). The operating mechanism (16) comprises a rotatable lever (18) having a cam surface (22A), which engages a cam surface (8B) on the moveable mandrel (8). The lever (18) also has a ratchet (24) engageable by a pawl (b 26). The ratchet teeth and the cam surface are formed so that the pawl (26) will only release when the cam surface (22A) has reached a predetermined position.

14 Claims, 5 Drawing Sheets

HAND CRIMPING TOOL

BACKGROUND OF THE INVENTION

This invention relates to hand crimping tools.

Such tools are used to attach terminals and connectors of a wide variety of sizes and shapes to electrical cables. The purpose of the tool is to ensure that the connector or terminal, is in proper electrical contact with the conductive element of the electrical cable.

Hand crimping tools and other crimping tools usually comprise a fixed and a moveable anvil or mandrel, on which the fixed and moveable parts of a crimping die can be mounted. The crimping dies are interchangeable in the tool so that a range of terminals and connectors of different sizes and shapes can be crimped using the same crimping tool.

In order to ensure that sufficient load is applied to the terminal or connector through the crimping die, it is important to control the movement of the moveable mandrel so that the moveable mandrel moves through sufficient distance to apply the necessary load, before the moveable mandrel can be released. Usually this movement is controlled by a ratchet and pawl mechanism, and the mechanism is only released by applying a load to the handle of the tool which is applying the movement to the moveable mandrel.

It has been found that applying the necessary load to the tool in order to disengage the pawl from the ratchet creates considerable stress on components of the tool which in turn reduces the force required to release the pawl from the ratchet during the crimping operation.

Usually, the lever which is applying the load to the moveable mandrel is connected to the moveable mandrel by one or more links, and the moveable mandrel is located in a guide, so that it can only move in a straight line. The links are connected to one another and to the lever and moveable mandrel by pivot pins, and it has been found that due to the loads applied during the crimping cycle and during the ratchet release movement, considerable wear occurs between the pins and links, creating a slackness in the operating mechanism. After a while, because of the slackness which has accumulated, it becomes progressively more difficult to apply the correct loads to the connectors and terminals, resulting in terminals and connectors not being crimped to the necessary standards.

SUMMARY OF THE INVENTION

The present invention seeks to provide a hand crimping tool, in which the ratchet and pawl mechanism can be released without applying a load greater than the crimping load to the tool, and in which the crimping load can be applied to the moveable mandrel in a manner in which wear and stress to the moving parts is reduced.

The present invention further seeks to provide a hand crimping tool in which adjustment is provided to compensate for any wear in the moving parts of the tool.

Accordingly, the present invention provides a hand crimping tool comprising a body having fixed mandrel, a moveable mandrel and a cam member moveable between at least two positions, a face on the moveable mandrel being urged into contact with the cam member, the cam member being moveable between positions corresponding to an open position and a closed position of the mandrels, the cam member having positioning means to locate and maintain the cam member in at least one position against movement in at least one direction, and release means to disengage the positioning means and allow the mandrels to move from the closed to the open position.

The face of the moveable mandrel can comprise a shaped face formed on the mandrel, or a roller rotatably mounted on the moveable mandrel.

The cam member can be formed to cause the moveable mandrel to travel between the open and closed positions and then to a further position allowing the positioning means to be disengaged by the release means and for the cam member to move to the position corresponding to the open position of the mandrels.

The positioning means can comprise a ratchet and pawl, the pawl engageable with successive teeth of the ratchet.

The pawl can be urged into engagement with the ratchet by spring means and the ratchet can have a projection engageable with the pawl to disengage the pawl from the ratchet upon the cam member being moved to the further position.

The pawl is pivotally mounted and can be a single action or a double action pawl.

The angle between adjacent teeth of the ratchet can be 90°, and the included angle of the pawl can be 90°, or less than 90°, for example 80°.

The cam member and positioning means are preferrably mounted on a common level member pivotally mounted in the body of the tool.

The common lever can be mounted in the tool body on a moveable mounting.

The moveable mounting can comprise a boss having an external diameter on the which the common lever can pivot, and an internally threaded bore eccentric to the external diameter, and the boss can be secured in position by a screw passing through a portion of the tool body and engaging the eccentric internally threaded bore.

The common lever can have spring means urging the lever to the position of the cam member corresponding to the open position of the mandrels.

The body can have an opening exposing a portion of the pawl allowing a release tool to be inserted through the opening to release the pawl from the ratchet.

Each or both of the mandrels can include mounting means for a crimp die.

BRIEF DESCRIPTION OF THE DRAWINGS

The present invention will now be more particularly described with reference to the accompanying drawings in which.

DESCRIPTION OF THE PREFERRED EMBODIMENT

Figure 1:
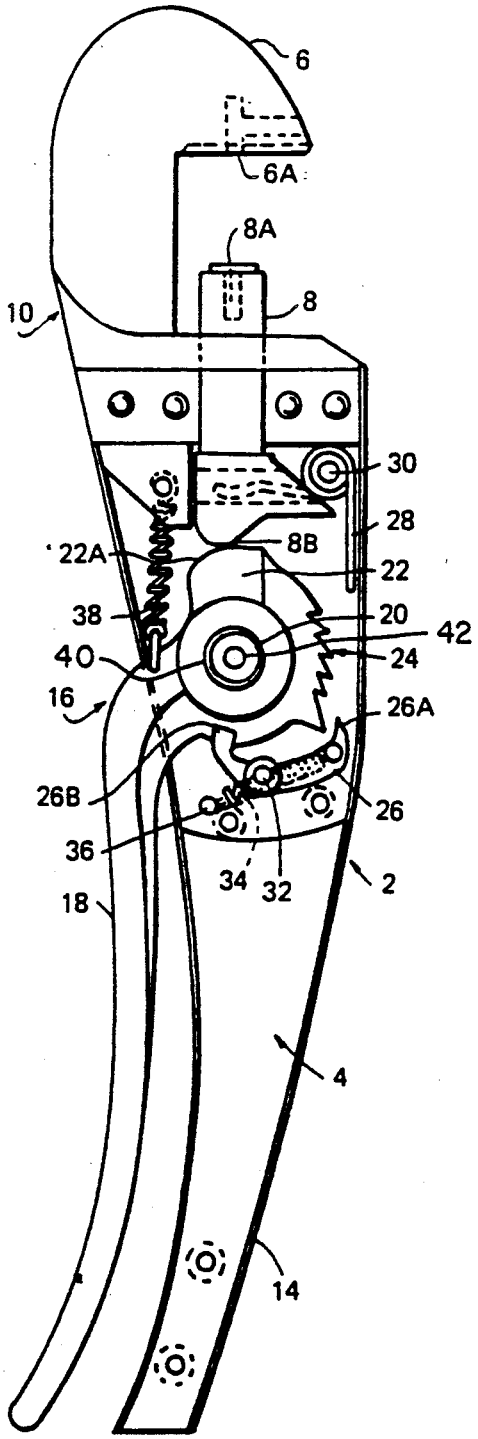
FIG. 1 shows an elevation of one form of crimping tool according to the present invention.

Referring to the FIGS. 1-5, there is shown a hand crimping tool comprising a body 2, which includes a handle 4, a fixed mandrel 6 attached to the body and a moveable mandrel 8, mounted in the body.

Each of the mandrels 6 and 8, have a recess 6A and 8A respectively to receive the mount of one part of a two part crimp die (not shown).

Figure 4:
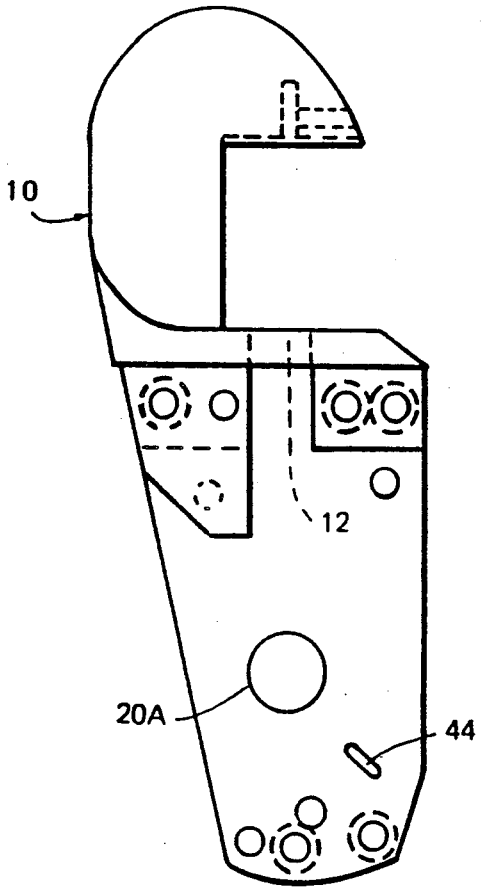
FIG. 4 shows a fixed mandrel illustrated in FIG. 1 in greater detail.

The fixed mandrel 6 forms part of an anvil 10 shown in more detail in FIG. 4 and includes a guide way 12 for the moveable mandrel 8.

The handle 4 which is formed from two generally channel section pressings, is attached to the anvil 10 by any suitable securing means such as bolts, screws or rivets. One of the pressings 14 is cut back (FIG. 1) to reveal an operating mechanism of the tool generally indicated at 16, and a cover plate, (not shown), is provided to conceal the main components of the operating mechanism when the tool is in use.

The operating mechanism 16 comprises a lever 18 which is pivotally mounted on a boss 20, the boss extending between the anvil 10 and the cover plate and secured to one of the handle sections 14 by screw 21. The lever 18 is formed with a cam member 22, having a cam surface 22A and a ratchet 24 engageable by a pawl 26. The cam surface 22A engages a follower surface 8B formed on the end of the moveable mandrel 8 remote from the recess 8A which comprises the mounting means for one part of the crimp die. The moveable mandrel 8 and thus the follower surface 8B, are urged into contact with the cam surface 22A by means of a spring 28 mounted on a pin 30 secured in the anvil 10.

Figure 3:
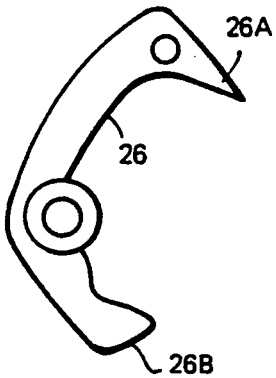
FIG. 3 shows a pawl illustrated in FIG. 1 in greater detail.

The pawl 26 which is shown clearly in FIG. 3, is mounted for rotation on a pin 32, and a spring 34 is attached between the ratchet engaging end of the pawl and an opening 36 in the anvil 10. The arrangment of the spring 34 and the mounting of the pawl 26 on the pin 32, is such that the spring can urge the pawl to engage or disengage the ratchet, as will be described in more detail below.

The lever 18 is loaded by a spring 38, which is attached between the upper end of the handle and the anvil 10 and tends to rotate the handle to an open position in a clockwise direction with reference to FIG. 1.

In order to the use the tool, the two parts of the selected crimp die are placed in the recesses 6A and 8A of the fixed and moveable mandrels 6 and 8. The lever 18 and thus the cam member 22 will be in an open position such that the fixed and movable mandrels are at their furthest distance apart, the crimp die thus being open since the spring 28 urges the moveable mandrel into contact with the cam surface 22A of the cam member 22. In this position the tooth 26A of the pawl 26 will be located between the first two teeth 24A, 24B, of the ratchet 24.

An electric cable together with a terminal or connector which is to be crimped, is placed between the two parts of the crimp die. The lever 18 is operated to move the mandrel 8 and thus its crimp die part towards the fixed mandrel 6 and its die part to crimp the connector or terminal, by virtue of the displacement caused by the co-operation between the cam surface 22A and the follower surface 8B on the moveable mandrel 8. At the same time that the lever 18 is being operated, the ratchet and pawl 24 and 26, will prevent the lever 18 from being moved in the opposite direction thereby releasing the crimping load. The cam surface 22A is designed such that when a predetermined displacement of the moveable mandrel 8 has been achieved, the tooth 26A of the pawl 26 is located between the last two teeth of the ratchet 24, thereby preventing the applied load from being released.

The cam surface 22A is also designed so that the lever 18 can be rotated to a further position which releases the load but allows the specially shaped last tooth 24C of the ratchet 24, to engage the tooth 26A of the pawl 26 and rotate the pawl about the pin 32. The spring 34 then causes the pawl to take up the position shown in FIG. 1. The lever 18 can then be rotated in a clockwise direction aided by the spring 38, thereby causing the moveable mandrel 8 to move back to the open position, so that the crimped connector or terminal and electric cable can be removed from the crimp die. The tooth 24C of the ratchet 24 will contact the heel 26B of the pawl 26, causing the pawl to rotate about the pin 32 and the spring 34 will then operate to urge the tooth 26A of the pawl 26 back into engagement between the first two teeth 24A, 24B, of the ratchet 24.

It will be appreciated that this arrangement ensures that the crimping cycle has to be completed before the handle 18 can be opened. Thus the required load is applied to the terminal or connector, and the pawl 26 can be disengaged from the ratchet 24 allowing the handle 18 to open, without applying unnecessary loads to other parts of the crimp tool.

Also as there is not linkage between the lever 18 and the moveable mandrel 8, little or no play between the operating mechanism and the moveable mandrel 8 will arise. If any wear does occur between the cam surface 22A and the follower surface 8B on the moveable mandrel 8, the tool has a compensation mechanism which is illustrated with reference to FIG. 5.

Figure 5:
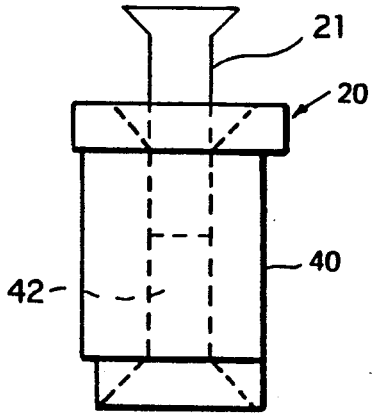
FIG. 5 shows a mounting boss for a lever illustrated in FIG. 1.

FIG. 5 illustrates the boss 20 upon which the lever 18 is rotatably mounted. The boss has an external diameter 40 upon which the lever 18 is mounteed and has an internal threaded bore 42, which is eccentric with respect to the diameter 40. The boss 20 is attached to the tool by means of fixing screw or bolt 21 which extends through one of the sections 14 of the handle 4 and the boss 20 extends between a bore 20A in the anvil 10 and a bore in the cover plate. It will be appreciated that if the boss 20 is rotated, the center of rotation of the lever 18 can be displaced and this displacement can be used to compensate for any wear in the operating mechanism. Once the boss has been rotated to the position which takes up the wear, the fixing screw of the boss 20 can be tightened to hold the boss in position.

If it is required to disengage the pawl from the ratchet, for example if the ratchet and pawl should become jammed for any reason, one or each pressing 14, or the cover plate (not shown) is provided with a slot (not shown) which corresponds to a slot 44 formed in the anvil 10. This slot and the associated slots in the handle or cover plate allow a tool to be inserted to disengage the pawl from the ratchet.

Figure 6:
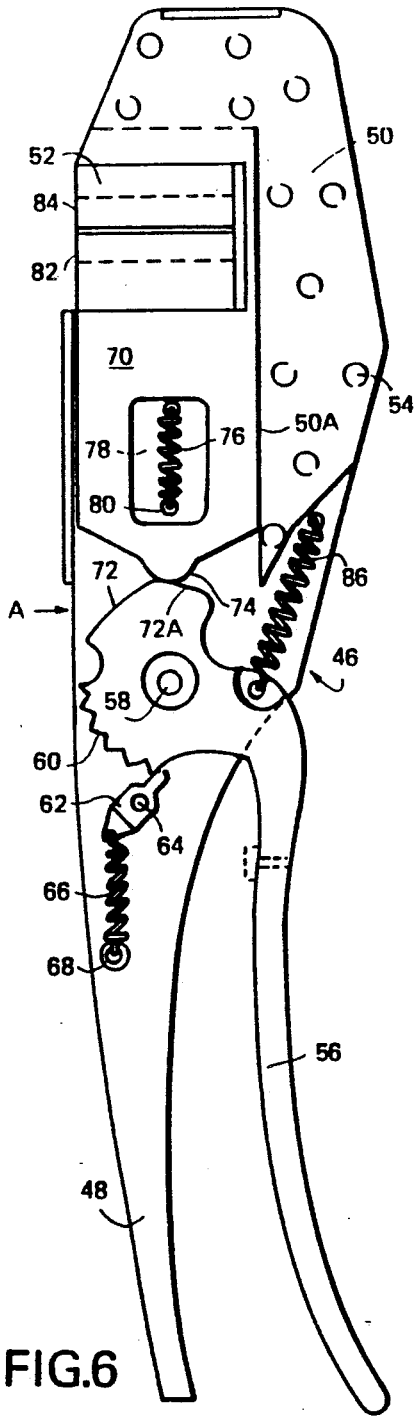
FIG. 6 shows a side elevation of a modified form of crimping tool according to the present invention.
Figure 7:
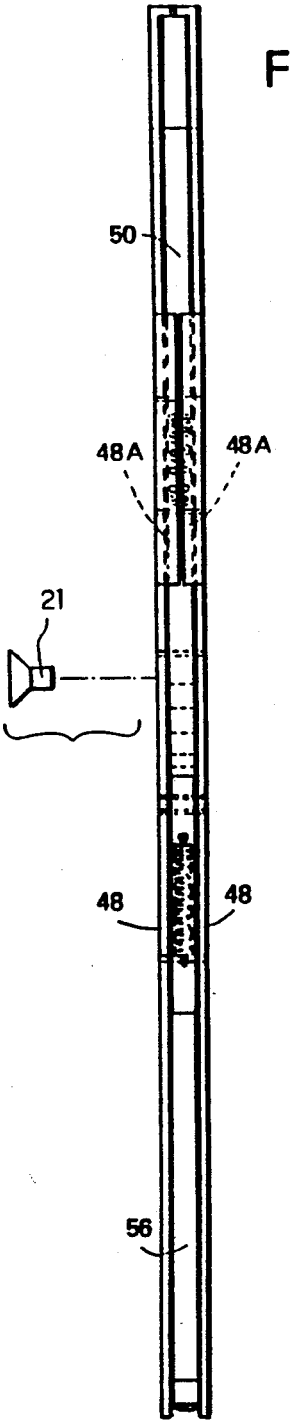
FIG. 7 shows a view on arrow A in FIG. 6

Referring to FIGS. 6 and 7 there is shown a modified form of crimp tool 46. The crimp tool 46 is formed from two side plates 48, and a reinforcing plate 50 which includes a fixed mandrel 52, is secured between the two side plates by rivets or spot welds 54. A lever 56 is rotatably mounted on a boss 58 which itself is rotatably mounted between the side plates 48 in the same manner as the boss 20 referred to in FIGS. 1 to 5. The lever 56 is formed with a ratchet 60 the teeth of which are engageable by a double-acting pawl 62. The pawl 62 is pivotally mounted on a peg 64 which is fixed between the side plates 48, and the pawl is biassed by a spring 66 which is attached at one end to the pawl and at the other end to a peg 68, which is also attached between the side plates 48.

A moveable mandrel 70 is located within the tool by a face 50A of the reinforcing plate 50 and flanges 48A of the side plates 48.

The lever 56 is provided with a cam surface 72 which is engaged by a part-circular follower surface 74 on the moveable mandrel 70. The moveable mandrel 70 is urged into contact with the cam surface 74 by means of a spring 76 located in a recess 78 in the moveable mandrel, attached at one end to the mandrel and at the other end to a peg 80, secured between the two side plates 48.

The ends of both the free and fixed mandrels 70 and 52 are appropriately shaped to take dies 82 and 84.

The handle 56 has a spring 86 which tends to open the tool.

The tool illustrated in FIGS. 6 and 7 operates in a very similar manner to the tool illustrated in FIGS. 1 to 5. It will be appreciated that the ratchet and pawl 60, 62 is a double acting mechanism which allows the handle 56 to operate in the same way as the design illustrated in FIGS. 1 to 5, i.e. the handle 56 has to be operated through the complete cycle to effect crimping before the handle can be opened. At the end the end of the cycle when the die parts are closed, the pawl 62 is disengaged from the ratchet 60, (as shown in FIG. 6), allowing the handle 56 to rotate in an anti-clockwise direction, and open the mandrels.

The cam surface 72 has an inclined plane portion 72A which allows for a wide range of tolerances on the dies 82 and 84.

Figure 8:
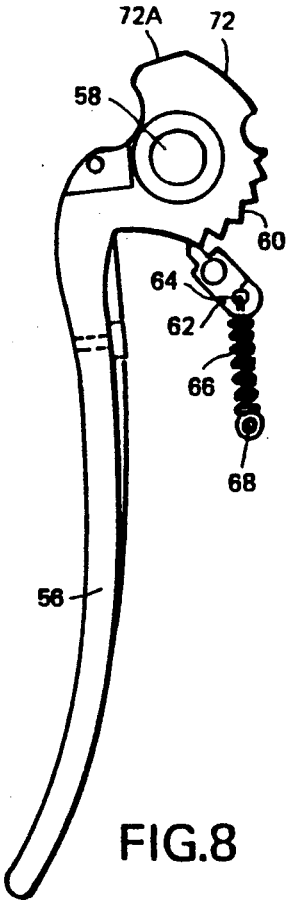
FIG. 8 shows a side elevation of a modified form of ratchet and pawl mechanism for use the crimp tool shown in FIGS. 1 to 5.

The single acting ratchet and pawl mechanism illustrated in FIG. 1 can be replaced by a lever having a double acting ratchet and pawl as illustrated in FIG. 8.

Referring to FIG. 8, the handle and pawl have been given the same reference numbers as used in FIG. 6. Thus, the lever 56 with ratchet 60, the pawl 62 and the spring 66 can be substituted directly for the lever 18, ratchet 24, pawl 26 and spring 34.

The angle between adjacent teeth of the ratchet 60 is 90°, and the included angle of the pawl 62 is 90°.

The operation of the crimp tool modified in this manner is identical to the operation of the crimp tool illustrated in FIGS. 6 and 7.

During the crimp operation, as the dies 82, 84 are being moved together by operation of the handle 56, the pawl 62 engages successive ones of the ratchet teeth, preventing the handle from being opened. The pawl 62 is disengaged from the ratchet at the end of the crimping operation and the handle can then be opened to allow the dies 82, 84 to move apart. The handle is fully opened so that the pawl disengages from the other end of the ratchet. The tool is then ready for the next crimping operation.

Figure 2:
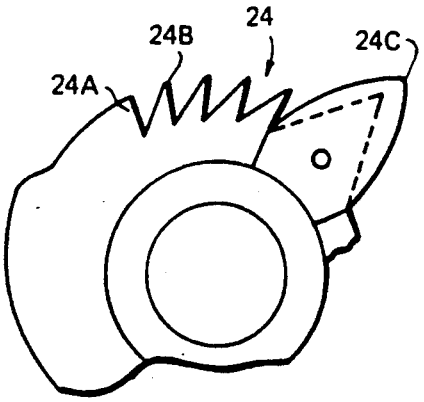
FIG. 2 shows a portion of a ratchet shown in FIG. 1 in greater detail.
Figure 9:
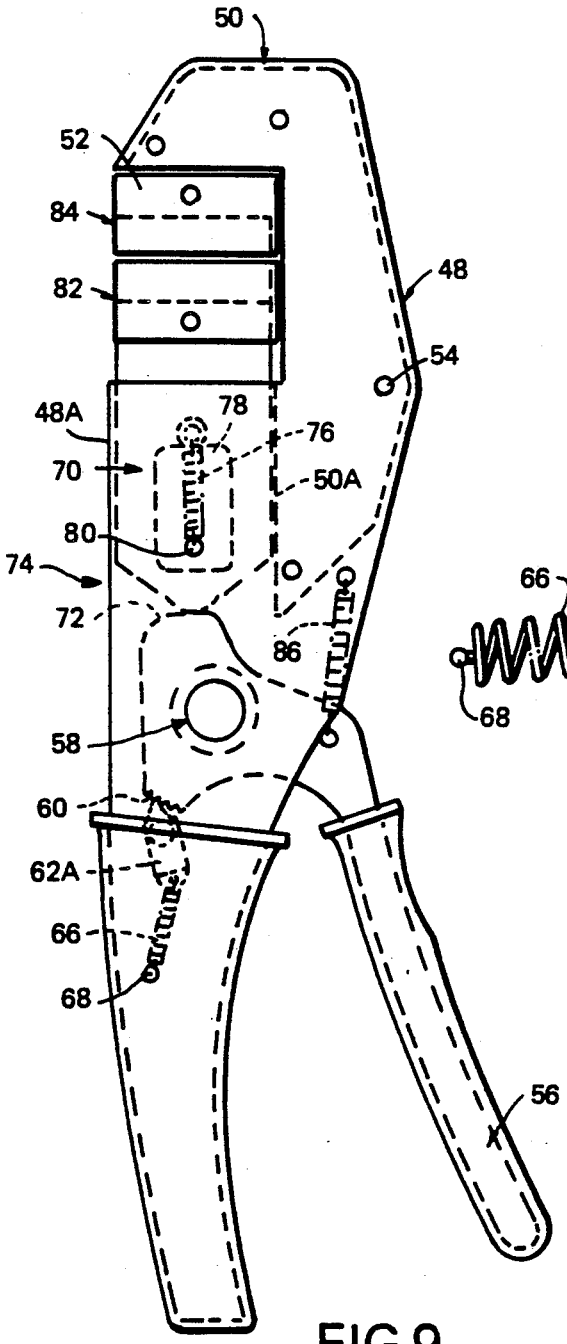
FIG. 9 shows a side elevation of a further form of crimping took according to the present invention.
Figure 10:
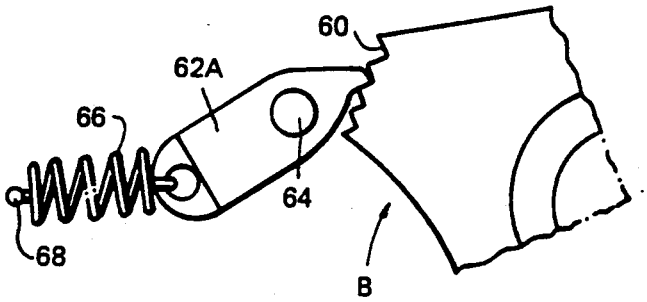
FIG. 10 shows the ratchet and pawl mechanism of the crimping tool in FIG. 9 in greater detail.
Figure 11:
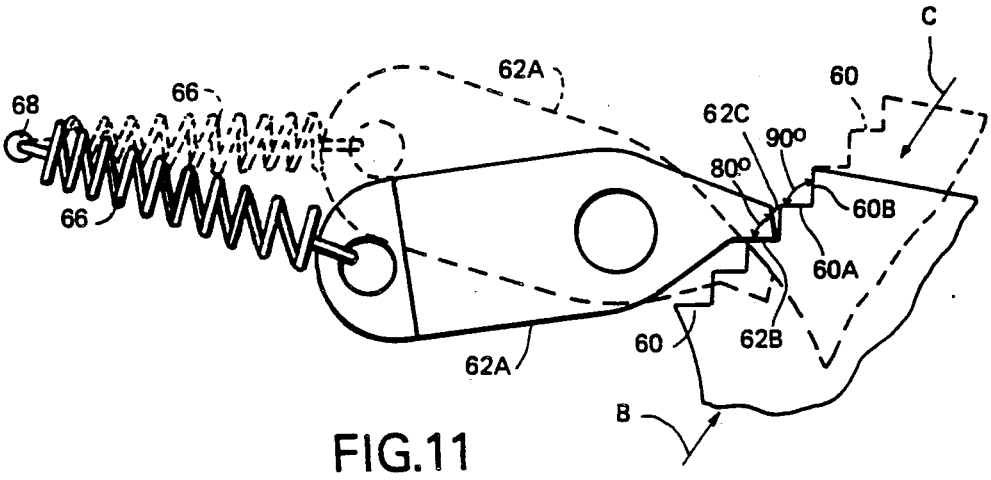
FIG. 11 is a similar view to the shown in FIG. 10 with the ratchet and pawl in two different positions.

FIGS. 9, 10 and 11 show a crimping tool 74 similar to that shown in FIG. 6 and corresponding components have been given identical references. Referring to FIGS. 9, 10 and 11, the crimping tool 74 comprises two side plates 48, and a reinforcing plate 50 which includes a fixed mandrel 52, is secured between the two side plates by rivets or spot welds 54. A lever 56 is rotatably mounted on a boss 58 which itself is rotatably mounted between the side plates 48 in the same manner as the boss 20 (FIGS. 1 and 2). The lever 56 is formed with a ratchet 60 the teeth of which are engageable by a double-acting pawl 62A. The pawl 62A has included angle of less than 90°, preferably 80°, and the angle between the teeth of the ratchet 60 is 90°.

The pawl 62A is pivotally mounted on a peg 64 which is fixed between the side plates 48, and the pawl is biassed by a spring 66 which is attached at one end to the pawl 62A and at the other end to a peg 68, which is also attached between the side plates 48.

A moveable mandrel 70 is located within the tool by a face 50A of the reinforcing plate 50 and flanges 48A of the side plates 48.

The lever 56 is provided with a cam surface 72 which is engaged by a part-circular follower surface 74 on the moveable mandrel 70. The mandrel 70 is urged into contact with the cam surface 74 by means of a spring 76 located in a recess 78 in the mandrel 70. The spring 76 is attached at one end to the mandrel 70 and at the other end to a peg 80 secured between the side plates 48. The ends of both the moveable and fixed mandrels 70 and 52 are appropriately shaped to take crimp dies 82 and 84. The handle 56 has a spring 86 which tends to open the tool.

The tool 74 operates in a similar manner to the tool 46 described with reference to FIGS. 6 and 7. Referring particularly to FIGS. 10 and 11 the pawl 62A is shown engaged between two adjacent teeth of the ratchet 60, at an intermediate stage of applying a crimping load. The handle 56 is being rotated in the direction of arrow B to move the mandrel 70 towards the mandrel 52.

The spring 66 urges a face 62B of the pawl 62A into contact with a face 60A of one of the ratchet teeth. It will be appreciated that if an attempt is made to open the tool by rotating the handle in the direction of arrow C, the pawl will remain in the position shown in FIG. 10 and will prevent rotation of the handle 56 in the direction of arrow C.

The handle 56 has to be rotated further in the direction of arrow B so that face 62B contacts successive faces 60A of the ratchet until the dies 82, 84 close and the pawl disengages from the ratchet, as indicated by the chain lines in FIG. 11.

The handle 56 can then be opened by rotation in the direction of arrow C and a face 62C of the pawl contacts successive faces 60B of the ratchet 60, until the pawl disengages from the other end of the ratchet.

Thus the crimping tool 74 ensures that the full load has to be applied to a component between the die parts by the handle 56 and moveable mandrel 70 before the handle can be opened to release the component.

Figure 12:
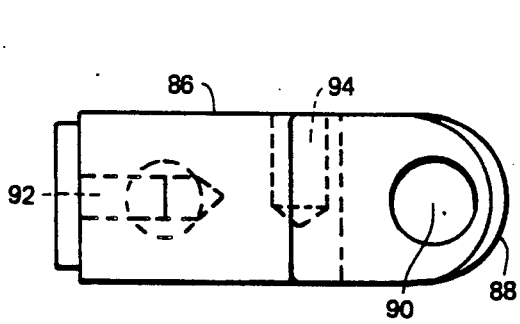
FIG. 12 shows a side elevation of a modified form of moveable mandrel for use with crimping tools according to the present invention.
Figure 13:
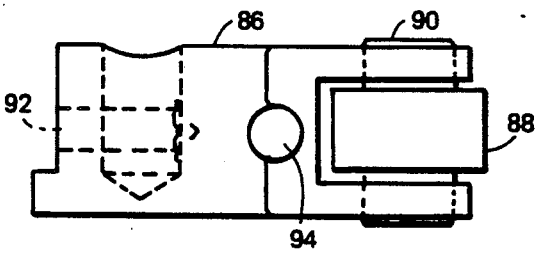
FIG. 13 is an plan view of the mandrel shown in FIG. 12.

Referring to FIGS. 12 and 13, an alternative form of moveable mandrel 86 is shown. The mandrel is provided with a roller 88 mounted on a pin 90, and the roller 88 acts as a cam follower. The mandrel 86 has a recess 92 to receive the mount of a crimp die, and a counterbore 94 to receive one of a spring (not shown).

The spring is arranged to urge the mandrel 86 and therefore the roller 88 into contact with cam surface (22, 72) on the handle (18, 56), in a similar manner to the spring 28 (FIG. 1) and spring 76 (FIGS. 6 and 9).

We claim:

1. A hand crimping tool comprising a body having a fixed mandrel and a linearly movable mandrel, and a pivotally mounted lever having a cam member at an end thereof and rotatable with the pivotal lever, a face on the linearly movable mandrel being urged into contact with the cam member, the lever being rotatable in one direction between positions of the cam member corresponding to an open position and a closed position of the mandrels, the cam member having positioning means preventing rotation counter to said one direction of the cam member once lever rotation is commenced in said one direction until the cam member reaches a position corresponding to the closed position of the mandrels, and release means to disengage the positioning means and allow the lever to rotate in a direction opposite to the one direction to a position corresponding to the open position of the mandrels, said lever being mounted on an adjustable mounting comprising a boss having an external diameter on which the lever can pivot and an internal threaded bore eccentric to the external diameter, the boss being secured in position by a screw passing through a portion of the tool body and engaging the eccentric internal bore so that the boss can be rotatively adjusted about said bore to vary the position of the cam member acting against the mandrel face.

2. A tool as claimed in claim 1, in which the cam member is formed to cause the moveable mandrel to travel between the open and closed positions and then to a further position allowing the positioning means to be disengaged by the release means and for the cam member to move to the position corresponding to the mandrel open position.

3. A tool as claimed in claim 1, in which the positioning means comprises a single-acting ratchet and pawl, the pawl engaging teeth of the ratchet corresponding to the two positions.

4. A tool as claimed in claim 3, in which the pawl is urged into engagement with the ratchet by spring means, and the release means comprises a projection engageable with the pawl to disengage the pawl from the ratchet, upon the cam member being moved to the further position.

5. A tool as claimed in claim 3, in which the pawl is pivotally mounted.

6. A tool as claimed in claim 1 in which the positioning means includes a double-acting ratchet and pawl.

7. A tool as claimed in claim 6 in which the angle between adjacent teeth of the ratchet is 90° and the included angle of the pawl is 90°.

8. A tool as claimed in claim 6 in which the angle between adjacent teeth of the ratchet is 90° and the included angle of the pawl is 80°.

9. A tool as claimed in claim 6 in which the pawl is arranged to be released from the ratchet at positions of the cam member corresponding to the closed and open positions of the mandrels.

10. A tool as claimed in claim 1, in which the common lever has spring means urging the lever to the position of the cam member corresponding to the open position of the mandrels.

11. A tool as claimed in claim 1, in which the body has an opening exposing a portion of the pawl allowing a release tool to be inserted through the opening to release the pawl from the ratchet.

12. A tool as claimed in claim 1 in which each or both mandrels include mounting means for a crimp die.

13. A tool as claimed in claim 1 in which the face on the moveable mandrel is integral with the moveable mandrel.

14. A tool as claimed in claim 1 in which the face on the moveable mandrel comprises a roller rotatably mounted in the moveable mandrel.

* * * * *

UNITED STATES PATENT AND TRADEMARK OFFICE

CERTIFICATE OF CORRECTION

PATENT NO. : 5,094,097

DATED : March 10, 1992

INVENTOR(S) : William H. TOOTH (deceased)

It is certified that error appears in the above-identified patent and that said Letters Patent is hereby corrected as shown below:

Title page,

Inventor's Line [19] change "TOOTH, deceased et al" to --TOOTH, deceased--

Signed and Sealed this

Thirteenth Day of July, 1993

*Attest:*

Michael K. Kirk

MICHAEL K. KIRK

*Attesting Officer*

*Acting Commissioner of Patents and Trademarks*